US008528691B1

(12) United States Patent
Carmichael et al.

(10) Patent No.: US 8,528,691 B1
(45) Date of Patent: Sep. 10, 2013

(54) SILENCER FOR FIREARM

(76) Inventors: Tony E. Carmichael, Coffee Springs, AL (US); Stacy A. Strickland, Enterprise, AL (US)

( * ) Notice: Subject to any disclaimer, the term of this patent is extended or adjusted under 35 U.S.C. 154(b) by 0 days.

(21) Appl. No.: 13/424,941

(22) Filed: Mar. 20, 2012

(51) Int. Cl.
*F41A 21/00* (2006.01)

(52) U.S. Cl.
USPC ..... 181/223; 89/14.3; 89/14.4

(58) Field of Classification Search
USPC ..... 181/223; 89/14.3, 14.4
See application file for complete search history.

(56) References Cited

U.S. PATENT DOCUMENTS

| | | | | |
|---|---|---|---|---|
| 4,584,924 | A | 4/1986 | Taguchi | |
| D415,812 | S | 10/1999 | Andrews, Jr. et al. | |
| D435,623 | S * | 12/2000 | Andrews et al. | D22/108 |
| 6,302,009 | B1 * | 10/2001 | O'Quinn et al. | 89/14.4 |
| 7,073,426 | B1 | 7/2006 | White | |
| 7,237,467 | B1 | 7/2007 | Melton | |
| D594,082 | S * | 6/2009 | O'Quinn | D22/108 |
| 7,587,969 | B2 | 9/2009 | Silvers | |
| 7,600,606 | B2 * | 10/2009 | Brittingham | 181/223 |
| 7,856,914 | B2 * | 12/2010 | Shults et al. | 89/14.4 |
| 7,931,118 | B1 | 4/2011 | Cronhelm | |
| 8,015,908 | B2 | 9/2011 | Kline et al. | |
| 8,087,338 | B1 * | 1/2012 | Hines | 89/14.4 |

* cited by examiner

*Primary Examiner* — Jeremy Luks
(74) *Attorney, Agent, or Firm* — George L Williamson

(57) ABSTRACT

Method and apparatus for a silencer for use on a conventional firearm wherein the silencer has a monolithic core which is machined from a single piece of metal or the like. The core is mounted in a tubular cover on the barrel of the firearm in the conventional manner. The silencer has a plurality of baffles which are disposed at opposite acute angles measured from a perpendicular line to the longitudinal axis of the silencer so that the baffles are disposed in an opposite configuration. Each of the baffles has serrated faces on both faces of the baffle and is supported by a rib disposed on the lateral midline of each baffle.

17 Claims, 2 Drawing Sheets

SILENCER FOR FIREARM

BACKGROUND OF THE INVENTION

1. Field of the Invention

The present invention relates generally to firearms and, more particularly, is concerned with a silencer for a firearm.

2. Description of the Related Art

Silencers for firearms have been described in the related art, however, none of the related art devices disclose the unique features of the present invention.

In U.S. Pat. No. 7,931,118 dated Apr. 26, 2011, Cronhelm disclosed a baffle for sound suppression. In U.S. Pat. No. 7,587,969 dated Sep. 15, 2009, Silvers disclosed an asymmetric firearm silencer with coaxial elements. In U.S. Pat. No. 8,015,908 dated Sep. 13, 2011, Kline, et al., disclosed a firearm silencer and methods for manufacturing and fastening the silencer onto a firearm. In U.S. Pat. No. 7,237,467 dated Jul. 3, 2007, Melton disclosed a sound suppressor. In U.S. Pat. No. D 415,812 dated Oct. 26, 1999, Andrews, Jr., et al., disclosed a firearms noise suppressor. In U.S. Pat. No. 4,584,924 dated Apr. 29, 1986, Taguchi disclosed a silencer for firearms. In U.S. Pat. No. 7,073,426 dated Jul. 11, 2006, White disclosed a sound suppressor.

While these firearm silencers may be suitable for the purposes for which they were designed, they would not be as suitable for the purposes of the present invention as hereinafter described.

SUMMARY OF THE PRESENT INVENTION

The present invention discloses a silencer for use on a conventional firearm wherein the silencer has a monolithic core which is machined from a single piece of metal or the like. The core is mounted in a tubular cover on the barrel of the firearm in the conventional manner. The silencer has a plurality of baffles which are disposed at opposite acute angles measured from a perpendicular line to the longitudinal axis of the silencer so that the baffles are disposed in an opposite configuration. Each of the baffles has serrated faces on both faces of the baffle and is supported by a rib disposed on the lateral midline of each baffle.

An object of the present invention is to provide an improved silencer for use on a conventional firearm. A further object of the present invention is to provide a baffle having a monolithic core machined from a single piece of metal or the like. A further object of the present invention is to provide baffles having opposite angular dispositions and having serrations on both faces thereon. A further object of the present invention is to provide a rib support on the lateral midline of each baffle. A further object of the present invention is to provide a baffle which can be easily used by an operator. A further object of the present invention is to provide a silencer which can be easily and relatively inexpensively manufactured.

The foregoing and other objects and advantages will appear from the description to follow. In the description reference is made to the accompanying drawings, which form a part hereof, and in which is shown by way of illustration specific embodiments in which the invention may be practiced. These embodiments will be described in sufficient detail to enable those skilled in the art to practice the invention, and it is to be understood that other embodiments may be utilized and that structural changes may be made without departing from the scope of the invention. In the accompanying drawings, like reference characters designate the same or similar parts throughout the several views.

The following detailed description is, therefore, not to be taken in a limiting sense, and the scope of the present invention is best defined by the appended claims.

BRIEF DESCRIPTION OF THE DRAWINGS

In order that the invention may be more fully understood, it will now be described, by way of example, with reference to the accompanying drawings in which.

LIST OF REFERENCE NUMERALS

Figure 1:
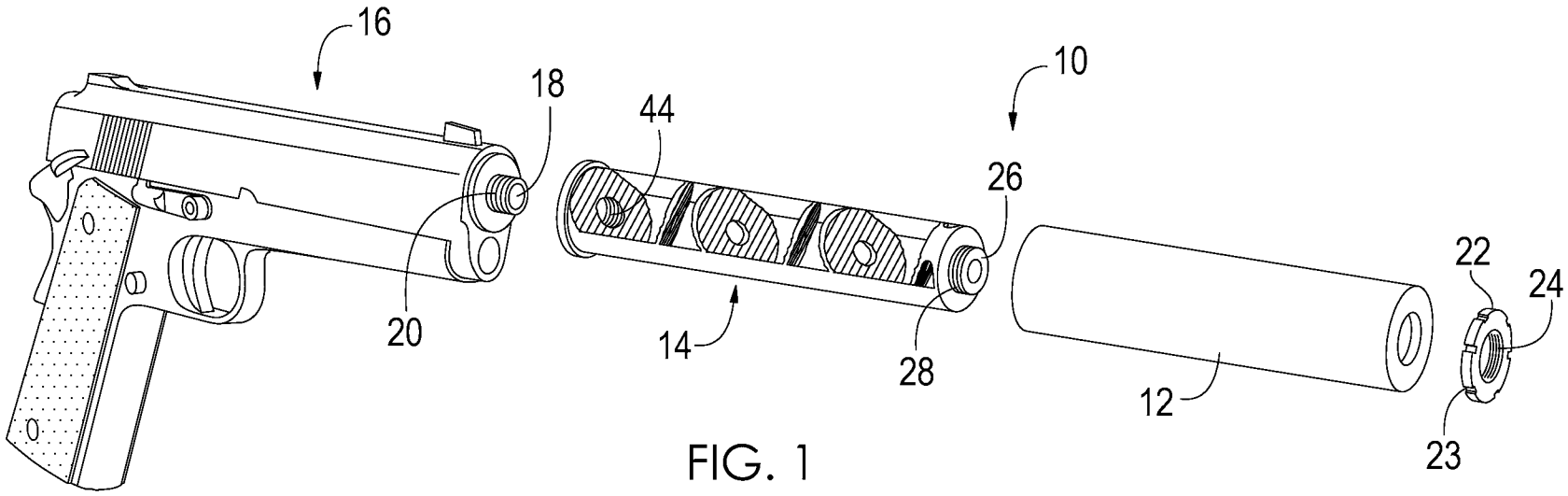
FIG. 1 is an exploded perspective of the present invention.

With regard to reference numerals used, the following numbering is used throughout the drawings.

10 present invention
12 cover
14 core
16 firearm
18 barrel
20 threads
22 fastener
23 slot
24 threads
26 end
28 threads
30 baffle
32 bullet aperture
34 expansion space
36 front end cap
38 exit aperture
40 rear end cap
41 shoulder
42 rib
44 threads
46 upper portion
48 lower portion
50 left side portion
52 right side portion
54 front surface portion
56 rear surface portion
58 serration/striation
60 sloping face
62 central axis
64 perpendicular line

DETAILED DESCRIPTION OF THE PREFERRED EMBODIMENT

The following discussion describes in detail at least one embodiment of the present invention. This discussion should not be construed, however, as limiting the present invention to the particular embodiments described herein since practitioners skilled in the art will recognize numerous other embodiments as well. For a definition of the complete scope of the invention the reader is directed to the appended claims. FIGS.

1 through 6 illustrate the present invention wherein a silencer/sound suppressor for a firearm is disclosed.

Turning to FIG. 1, therein is shown the present invention 10 being a silencer/sound suppressor having an outer tubular casing or cover 12 for receiving internally therein the core 14 of the present invention for being mounted onto the barrel of a conventional firearm 16 wherein the end of the barrel 18 has external threads 20 thereon so that the mating internal threads 44 of the core are screwed onto the threads 20. The cover is then placed over the core 14 so that the cover is securely held to a firearm 16 using a fastener 22, e.g., a spanner nut, having internal threads 24 thereon for being attached to barrel-like extension end 26 of the core having external mating threads 28 for receiving the fastener 22 so that the cover and core are secured onto the barrel 18 of the firearm 16.

Figure 2:
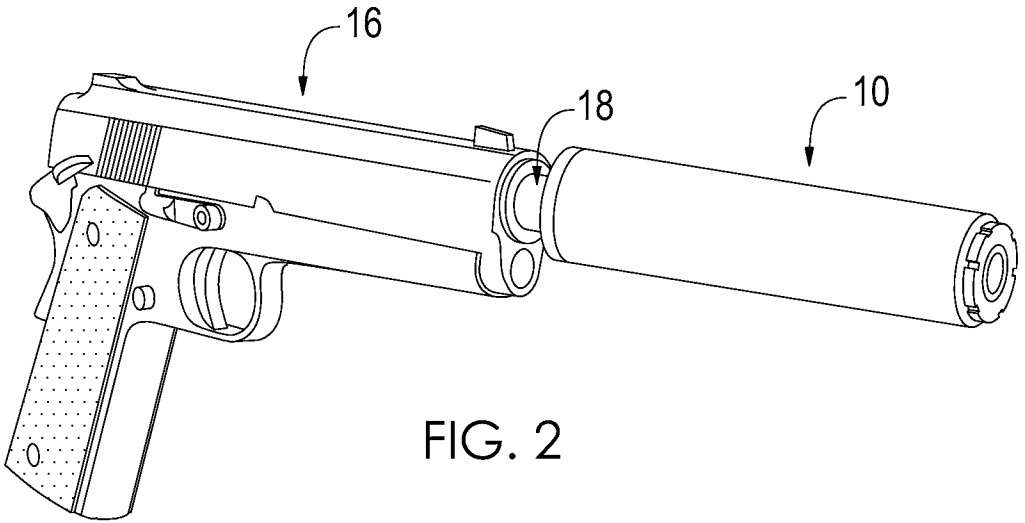
FIG. 2 is a perspective view of the present invention shown in operative connection.

Turning to FIG. 2, therein is shown the present invention 10 mounted onto a barrel 18 of a conventional firearm 16.

Figure 3:
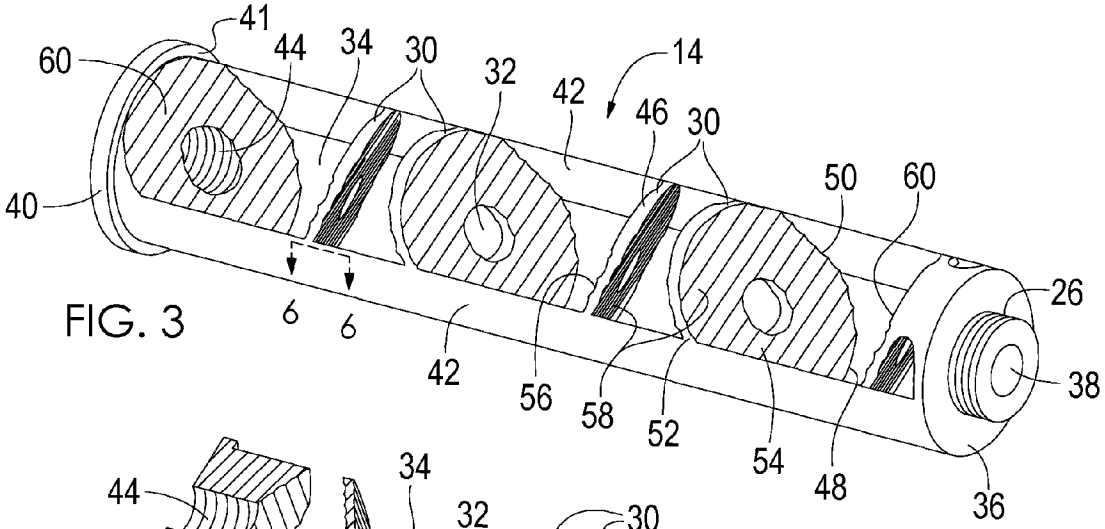
FIG. 3 is a perspective view of the core of the present invention.

Turning to FIG. 3, therein is shown a monolithic core 14 having a plurality of effectively sized, shaped and spaced-apart disk-like baffles 30 each having a bullet aperture 32 therein with effectively sized expansion spaces 34 shown inside the core between each of the baffles; each baffle has an upper portion 46, lower portion 48, left and right side portions 50, 52 and front and rear surface portions 54, 56 and a plurality of serrations/striations 58 thereon formed by the bit of the 3D tool path milling machine. A sloping inner face or surface 60 is shown on each end cap 40, 36. Also shown is a front end cap 36 along with an exit aperture 38 and a rear end cap 40 wherein the diameter of the exit aperture is sized to be about 65 thousandths of an inch greater than the diameter of the bullet and a shoulder 41 is provided for receiving the rear end of the tubular cover. Also shown are left and right side ribs 42 which are attached to the left and right side portions 50, 52 of baffles 30 along a lateral midline of each of the baffles. Other previously disclosed elements may also be shown.

Figure 4:
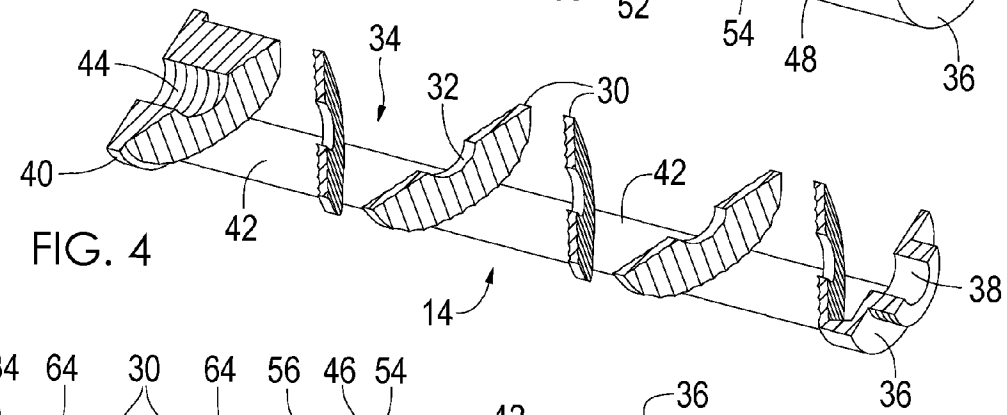
FIG. 4 is a cross sectional view of the core of the present invention.

Turning to FIG. 4, therein is shown a monolithic core 14 having a plurality of baffles 30 each having a bullet aperture 32 therein with inner expansion spaces 34 shown between each of the baffles. Also shown is a front end cap 36 along with an exit aperture 38 and a rear end cap 40. Also shown is one side ribs 42 which is attached to a side portion of baffles 30 along a lateral midline of the baffle.

Figure 5:
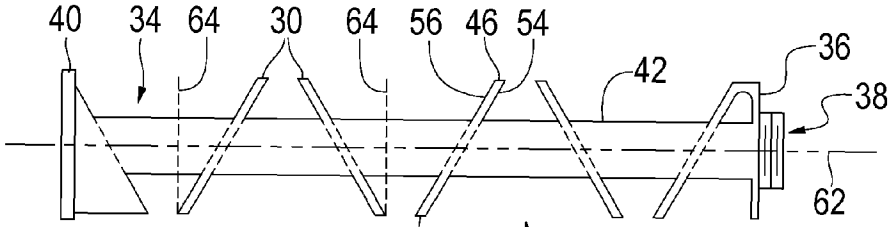
FIG. 5 is a side elevation view of the core of the present invention.

Turning to FIG. 5, therein is shown a monolithic core 14 having a plurality of baffles 30 each having a bullet aperture therein with inner expansion spaces 34 shown between each of the baffles; each baffle has an upper portion 46, lower portion 48, left and right side portions and front and rear surface portions 54, 56 and a plurality of serrations thereon. Also shown is a front end cap 36 along with an exit aperture 38 and a rear end cap 40. Also shown are the side ribs 42 which are attached to the left and right side portions of baffles 30 along a lateral midline of the baffle. The silencer 10 has a plurality of baffles 30 which are disposed at opposite acute angles to each other, the angle being measured from a line 64 perpendicular to the longitudinal central axis 62 of the core of the silencer so that the baffles are disposed in an opposite angular configuration to each adjacent baffle and/or the sloping faces 60 (not shown, see FIG. 3).

Figure 6:
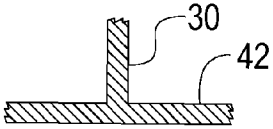
FIG. 6 is a cross sectional view of portions of the present invention taken from FIG. 3 as indicated.

Turning to FIG. 6, therein is shown rib 42 and baffle 30 to illustrate the monolithic construction of the present invention wherein there is no joint, i.e., jointless/seamless, at the point of connection between the rib and baffle.

The following general discussion makes reference to FIGS. 1-6. The present invention 10 discloses a monolithic core/baffle 14, 30 design for a firearm sound suppressor formed from a billet core. This means that it is machined from bar stock with no casting or welding. It is made completely from machining it from one piece of metal or other suitable material. The pyramid shape is made using a 3D tool path milling machine, with the bit of the tool leaving rippled striations or serrations 58 covering each baffle 30 on both sides, thus continuing to increase the surface area and providing obstructions that the gas has to encounter repeatedly. With each encounter, the gas continues to slow significantly. These features, along with the following features, make the present invention 10 different from conventional silencers. 1) There is no welding of the baffles 30 into the monolithic core 14. The baffles 30 are designed to be incorporated directly into the monolithic core 14 which improves performance and gives the added benefit of simplicity. 2) When the weapon is fired, the gas has to move through the monolithic core 14 and it is forced to encounter the ripples/serrations 58 on both sides of each baffle 30. 3) The rib 42 support for the baffles 30 being on the side adds strength and allows the gas to flow directly to the outer tube 12. The effectiveness of this suppressor can be seen easily by the lack of a muzzle flash and can be heard due to minimization of substantially all of the noise. 4) Any pair of baffles 30 are arranged in a "V" pattern so that when the baffles are viewed from a side elevation view such as FIG. 5, any pair of baffles will have a "V" shape with the vertex of the "V" being disposed either upwardly or downwardly, i.e., each pair of baffles will have a configuration or "V" orientation opposite to the adjacent pair of baffles. This allows for increased strength of the suppressor and lets the gas come into contact with the each of the sides of the baffles 30 which forces the gas to encounter more surface area inside the monolithic core before the projectile and gas exit the silencer. 5) The core 14 is made by utilizing a 3D tool path as opposed to other designs which are merely straight through cuts.

We claim:

1. A sound suppressor for a firearm, the firearm having a barrel being threaded on its front end, comprising:

a) a tubular cover having front and rear end portions, said cover being closed with a centrally disposed bullet aperture on said front end portion, said cover being open on said rear end portion;

b) a core, said core having front and rear end portions, left and right side portions, and a central axis, wherein said core is removably inserted into said tubular cover;

c) left and right ribs being disposed on said left and right side portion, respectively, of said core and extending from said front end to said rear end of said core;

d) a plurality of baffles disposed in said core, each said baffle having upper and lower portions, left and right side portions, front and rear surface portions, and a centrally disposed bullet aperture therein, wherein each said left side portion of each said baffle is disposed on said left rib and each right side portion of each said baffle is disposed on said right rib, wherein said baffles are spaced apart between said front and rear end portions of said core so as to form an expansion space between each said baffle and its adjacent baffle;

e) wherein each baffle in said plurality of baffles is disposed at an opposite acute angle to each adjacent baffle so that closest parts of adjacent baffles are spaced from each other with no overlapping of adjacent baffles, wherein the angle is measured with respect to a line perpendicular to said central axis of said core; and f) both front and rear surfaces of every baffle having serrations, whereby firing gasses are forced to encounter serrations on both sides of each baffle.

2. The sound suppressor of claim 1, wherein each said baffle is disposed on each said rib at a lateral mid line of said baffle.

3. The sound suppressor of claim 2, wherein said baffle and said rib have a point of connection, wherein said point of connection is seamless.

4. The sound suppressor of claim 1, wherein said core is formed from a single piece of material.

5. The sound suppressor of claim 3, further comprising an inner sloping face being disposed on each said front and rear end portion of said core in opposite directions to each other.

6. A sound suppressor for a firearm, the firearm having a barrel being threaded externally on its front end, comprising:

a) a tubular cover having front and rear end portions, said cover being closed on said front end portion with a centrally disposed bullet aperture, said cover being open on said rear end portion;

b) a core, said core being complimentarily sized and shaped for removable insertion into said tubular cover, said core having front and rear end portions and left and right side portions, and a central axis, a front end cap being disposed on said front end portion and a rear end cap being disposed on said rear end portion, each said front and rear end cap having a centrally disposed bullet aperture therein, said rear end cap having internal threads disposed around said aperture for mating with the external threads on the barrel of the firearm to permit said core to be removably attached to the barrel of the firearm, wherein said cover is adapted for being removably attached to said core;

c) left and right ribs being disposed on said left and right side portion, respectively, of said core and extending from said front end to said rear end of said core;

d) a plurality of baffles disposed in said core, each said baffle having upper and lower portions, left and right side portions, front and rear surface portions, and a centrally disposed bullet aperture therein, wherein each said left side portion of each said baffle is disposed on said left rib, wherein each right side portion of each baffle is disposed on said right rib, wherein said baffles are spaced apart between said front and rear end portions of said core so as to form an expansion space between each said baffle and its adjacent baffle; and, e) wherein each baffle in said plurality of baffles is disposed at an opposite acute angle to each adjacent baffle so that closest parts of adjacent baffles are spaced from each other and there is no overlapping of adjacent baffles, wherein the angle is measured with respect to a line perpendicular to said central axis of said core.

7. The sound suppressor of claim 6, wherein each said baffle is disposed on each said rib at a lateral mid line of said baffle.

8. The sound suppressor of claim 7, wherein said baffle and said rib have a point of connection, wherein said point of connection is seamless.

9. The sound suppressor of claim 6, wherein said core is formed from a single piece of material.

10. The sound suppressor of claim 6, further comprising an inner sloping face being disposed on each said front and rear end portion of said core.

11. The sound suppressor of claim 6, further comprising a plurality of serrations being disposed on each said front and rear surface portion of each said baffle whereby firing gasses are forced to encounter serrations on both sides of all baffle.

12. The sound suppressor of claim 6, further comprising an extension end being disposed on said front end portion of said core, said extension end having external threads thereon for receiving a fastener, wherein said extension end protrudes through said aperture on said front end of said tubular cover and said fastener is placed on said extension end to removably attach said tubular cover to said core.

13. A method of making a sound suppressor for a firearm, the firearm having a barrel being threaded on its front end, comprising the steps of:

a) providing a tubular cover having front and rear end portions and being closed with a centrally disposed bullet aperture on the front end portion, the cover being open on the rear end portion;

b) providing a core having front and rear end portions, left and right side portions, and a central axis, wherein the core is removably inserted into the tubular cover;

c) providing left and right ribs on the left and right side portion, respectively, of the core extending from the front end to the rear end of the core;

d) providing a plurality of baffles in the core, each baffle having upper and lower portions, left and right side portions, front and rear surface portions, and a centrally disposed bullet aperture therein, wherein each left side portion of each baffle is disposed on the left rib and each right side portion of each baffle is disposed on the right rib, wherein the baffles are spaced apart between the front and rear end portions of the core to form an expansion space between each baffle and its adjacent baffle; and, e) wherein each baffle in said plurality of baffles is disposed at an opposite acute angle to each adjacent baffle so that closest parts of adjacent baffles are spaced from each other and there is no overlapping of adjacent baffles, wherein the angle is measured with respect to a line perpendicular to the central axis of the core; and f) providing both front and rear surfaces of every baffle with serrations whereby firing gasses are forced to encounter both sides of each said baffle upon firing said firearm.

14. The method of claim 13, further comprising the step of attaching each baffle to each rib at a lateral mid line of the baffle.

15. The method of claim 14, wherein the baffle and the rib have a seamless point of connection.

16. The method of claim 13, forming the core from a single piece of material.

17. The method of claim 13, further comprising the step of providing an inner sloping face on each front and rear end portion of the core.

* * * * *